US010815805B2

(12) United States Patent
Johnson et al.

(10) Patent No.: US 10,815,805 B2
(45) Date of Patent: Oct. 27, 2020

(54) APPARATUS FOR SUPPLYING COOLING AIR TO A TURBINE

(71) Applicant: General Electric Company, Schenectady, NY (US)

(72) Inventors: Steven Douglas Johnson, Milford, OH (US); Nicholas R. Dinsmore, Marblehead, MA (US); Daniel Tyler Jarboe, West Chester, OH (US)

(73) Assignee: General Electric Company, Schenectady, NY (US)

( * ) Notice: Subject to any disclaimer, the term of this patent is extended or adjusted under 35 U.S.C. 154(b) by 848 days.

(21) Appl. No.: 15/411,592

(22) Filed: Jan. 20, 2017

(65) Prior Publication Data

US 2018/0209300 A1 Jul. 26, 2018

(51) Int. Cl.

| | |
|---|---|
| ***F01D 9/06*** | (2006.01) |
| ***F01D 11/00*** | (2006.01) |
| ***F01D 11/06*** | (2006.01) |

(52) U.S. Cl.

CPC ..... *F01D 9/065* (2013.01); *F01D 11/001* (2013.01); *F01D 11/06* (2013.01)

(58) Field of Classification Search

CPC ..... F01D 9/065; F01D 11/001; F01D 11/06; F01D 9/041; F01D 25/12; F01D 11/02

See application file for complete search history.

(56) References Cited

U.S. PATENT DOCUMENTS

| | | | | |
|---|---|---|---|---|
| 2,988,325 | A * | 6/1961 | Dawson | F01D 5/081 415/110 |
| 3,945,758 | A * | 3/1976 | Lee | F01D 5/187 415/144 |
| 4,113,406 | A * | 9/1978 | Lee | F01D 11/001 415/115 |
| 5,472,313 | A * | 12/1995 | Quinones | F01D 5/082 415/115 |
| 6,217,279 | B1 * | 4/2001 | Ai | F01D 9/065 415/110 |
| 6,398,488 | B1 * | 6/2002 | Solda | F01D 5/081 415/115 |
| 6,884,023 | B2 | 4/2005 | Dube et al. | |
| 7,007,488 | B2 * | 3/2006 | Orlando | F01D 9/065 60/782 |
| 8,517,666 | B2 * | 8/2013 | Alvanos | F01D 5/081 415/115 |
| 9,303,526 | B2 | 4/2016 | Chir et al. | |

* cited by examiner

*Primary Examiner* — Phutthiwat Wongwian
*Assistant Examiner* — Arnold Castro
(74) *Attorney, Agent, or Firm* — General Electric; James Reed

(57) ABSTRACT

A turbine interstage structure for a gas turbine engine that includes a first stage disk and a second stage disk. A central plenum is defined by a an inner band for supporting nozzle vanes, a forward stator plate and an aft stator plate wherein the forward stator plate is spaced-apart from the aft stator plate, and an inner boundary. A forward mid-seal positioned between the inner boundary and the forward stator plate. An aft mid-seal positioned between the inner boundary and the aft stator plate; and wherein the inner boundary is a solid annular component.

19 Claims, 3 Drawing Sheets

APPARATUS FOR SUPPLYING COOLING AIR TO A TURBINE

BACKGROUND OF THE INVENTION

The present invention relates to gas turbine engines and more specifically to sealing between stages within turbomachinery.

A gas turbine engine includes, in serial flow communication, a compressor, a combustor, and a turbine. The turbine is mechanically coupled to the compressor and together the three components define a turbomachinery core. The core is operable to generate a flow of hot, pressurized combustion gases. The core forms the basis for several aircraft engine types such as turbojets, turboprops, and turbofans.

Conventional gas turbine engines include an interstage structure defined by a forward disk, an aft disk. A mid-seal disk is positioned between the forward disk and the aft disk and a rotating mid-seal located near the inner band. Because the potential for leaks increases with increases in sealing circumference, potential leakage across the mid-seal increases with the distance that the mid-seal is positioned away from an engine axis. Stated another way, potential for leaks and a rotating seal increases with the radius of the rotating seal. Therefore, there is a need for a mid-seal structure that is positioned closer to the engine axis.

BRIEF DESCRIPTION OF THE INVENTION

This need is addressed by an apparatus that includes an interstage structure that includes two mid-seals and a central plenum.

According to one aspect of the present invention, there is provided a turbine interstage structure for a gas turbine engine that includes a first stage disk and a second stage disk. A central plenum is defined by a an inner band for supporting nozzle vanes, a forward stator plate and an aft stator plate wherein the forward stator plate is spaced-apart from the aft stator plate, and an inner boundary. A forward mid-seal positioned between the inner boundary and the forward stator plate. An aft mid-seal positioned between the inner boundary and the aft stator plate; and wherein the inner boundary is a solid annular component.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
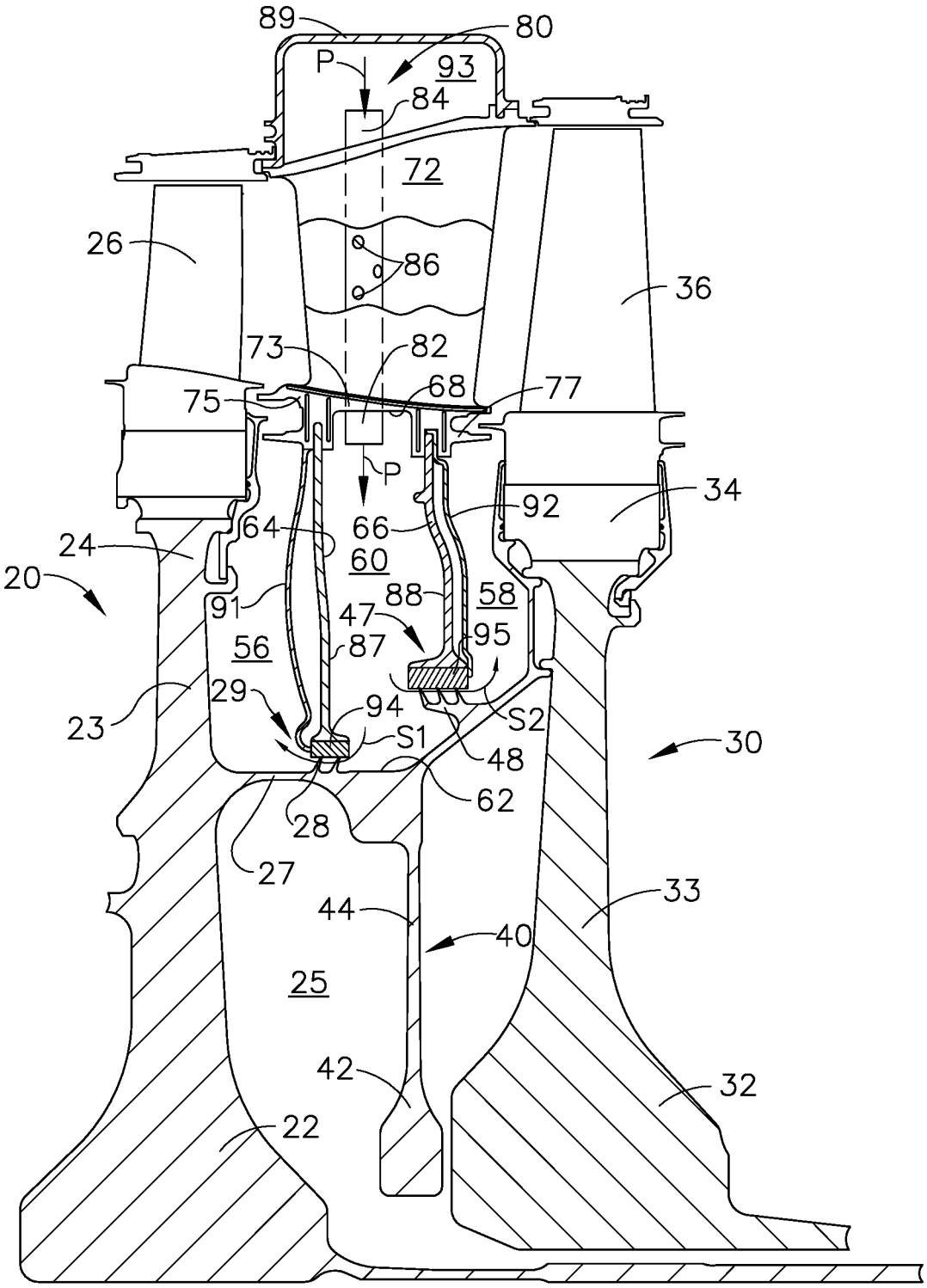
FIG. 1 is a sectional view with partial cutaways of an interstage structure between a forward disk and an aft disk within a high pressure turbine of a gas turbine engine.

Referring to the drawings wherein identical reference numerals denote the same elements throughout the various views, FIG. 1 depicts a sectional view of an annular interstage structure 10 of a gas turbine engine 9. The engine 9 can be for several different aircraft engine types such as turbojets, turboprops, and turbofans. The interstage structure 10 includes elements that are bodies of revolution extending around an axis 2 of the engine 9 and multiple individual elements that are radially distributed around the axis 2.

The engine 9 has a longitudinal center line or axis 2. As used herein, the terms "axial" and "longitudinal" both refer to a direction parallel to the centerline axis 2, while "radial" refers to a direction perpendicular to the axial direction, and "tangential" or "circumferential" refers to a direction mutually orthogonal to the axial and tangential directions. As used herein: the terms "forward" or "front" refer to a location relatively upstream in an air flow passing through or around a component; the terms "aft" or "rear" refer to a location relatively downstream in an air flow passing through or around a component; the terms "inner" and "radially inward" refer to locations relatively closer to the axis; and the terms "outer" and "radially outward" refer to locations relatively further from the axis. The direction of this flow is shown by the arrow "F" in FIG. 3. These directional terms are used merely for convenience in description and do not require a particular orientation of the structures described thereby.

Figure 2:
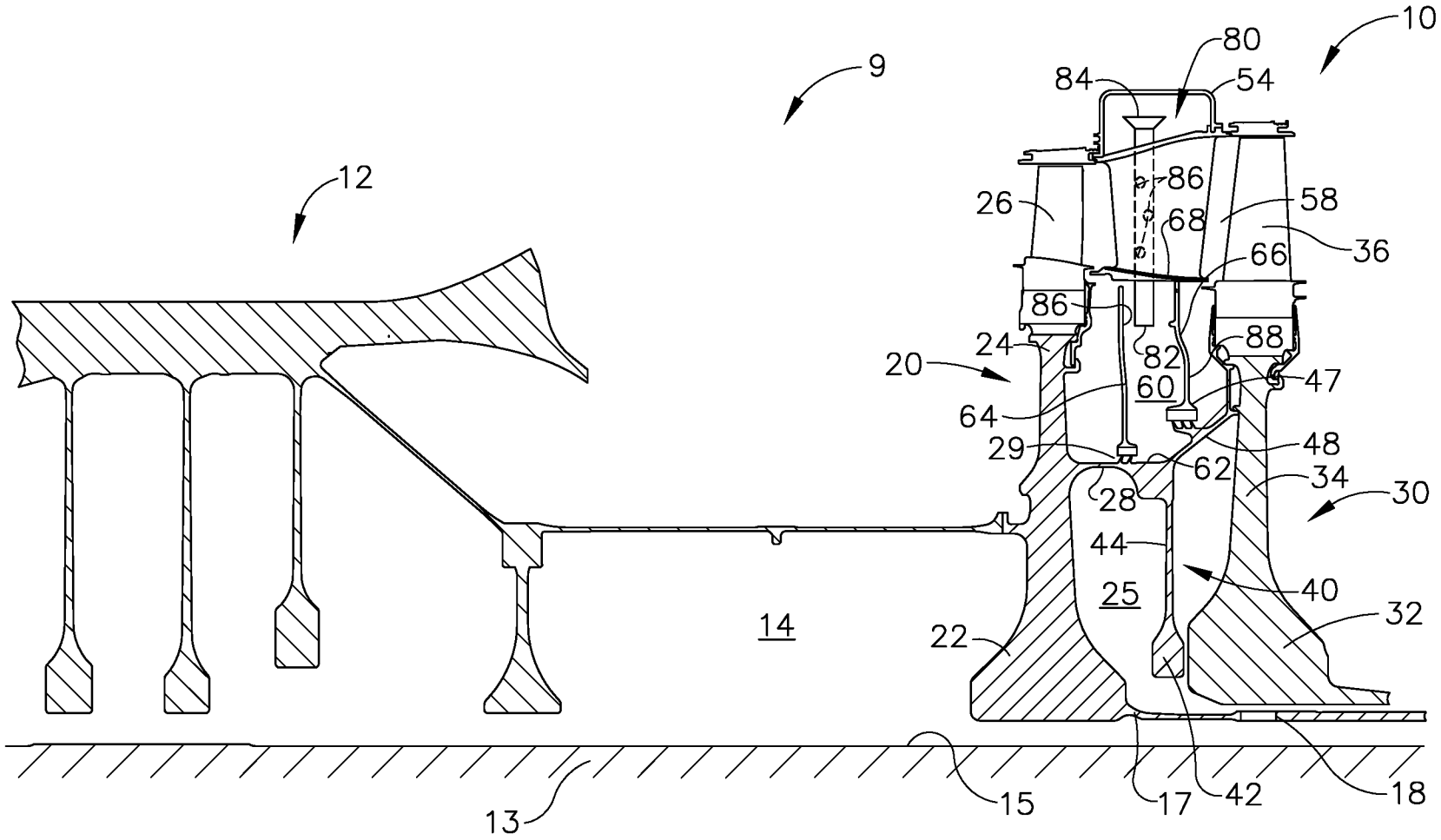
FIG. 2 is a sectional view with partial cutaways of the compressor and the high pressure turbine of the engine shown in FIG. 1.
Figure 3:
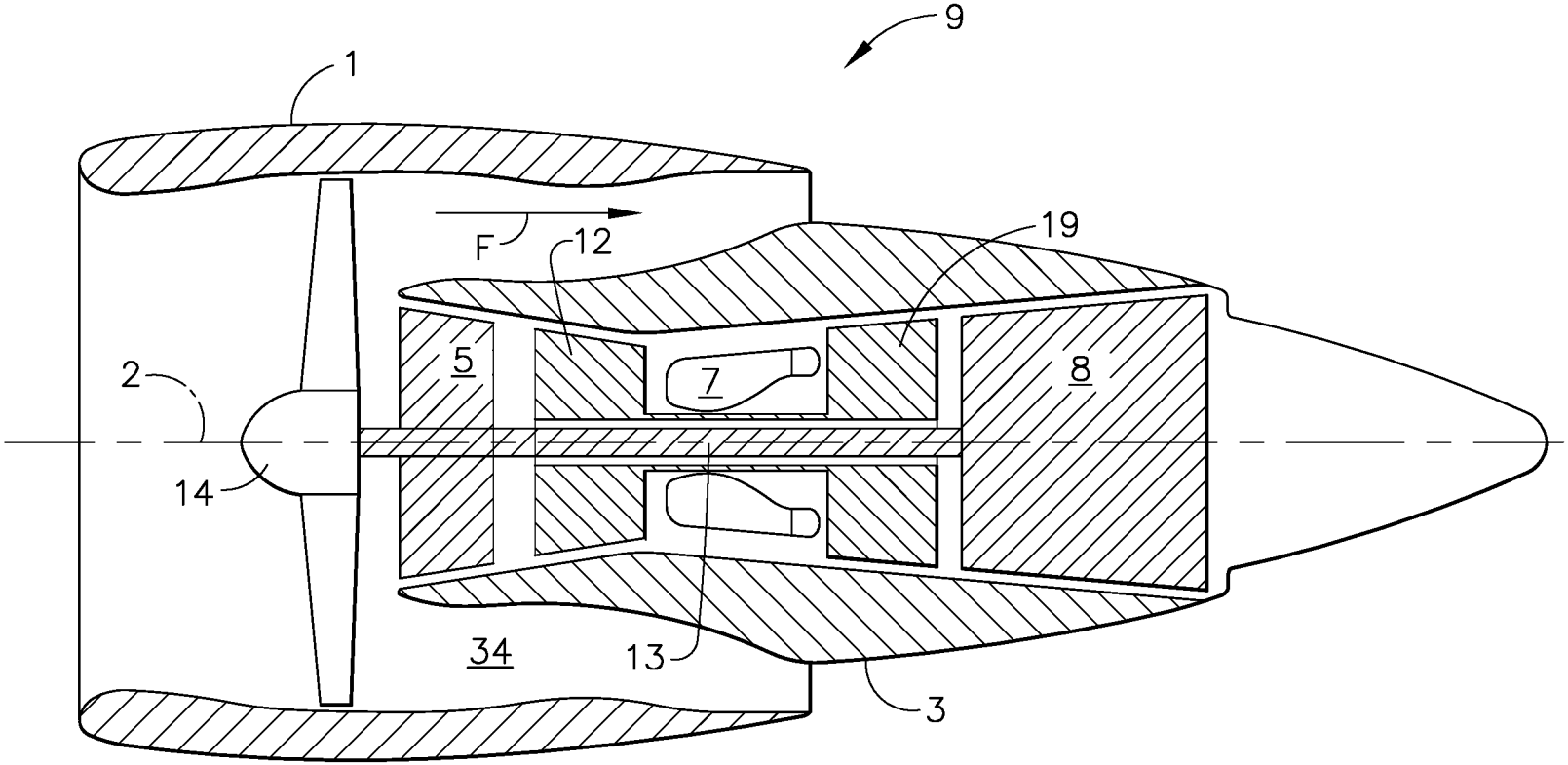
FIG. 3 is a schematic view of a conventional gas turbine engine.

Referring now to FIGS. 2 and 3, the engine 9 includes a fan nacelle 1 that is disposed concentrically about and coaxially along the axis 2. The fan nacelle 1 is configured to house an inner core 3 such that the inner core 3 and the fan nacelle 1 share the axis 2. A fan 4 is positioned within the fan nacelle 1 such that it is forward of the inner core 3. A booster 5, a compressor 12, a combustor 7, a high pressure turbine 19, and a low pressure turbine 8 are positioned within the inner core 3. The fan 4, the booster 5, the compressor 12, the combustor 7, the high pressure turbine 19, and the low pressure turbine 8 are arranged in serial flow relationship.

A shaft 13 extends between the compressor 12 and the high pressure turbine 19 such that they are mechanically connected. As seen in FIG. 2, a chamber 14 is defined aft of the compressor 12 and forward of the high pressure turbine 19.

Referring now to FIG. 1, the interstage structure 10 is generally defined by a first stage disk 20 and a second stage disk 30. The first stage disk 20 and the second stage disk 30 are bodies of revolution. The first stage disk 20 and the second stage disk 30 in part define an annular inner chamber 25.

The first stage disk 20 includes a first stage disk bore 22 and a first stage disk web 23 that extends to a rim 24. A plurality of radially disposed first stage blades 26 extends outwardly from the rim 24. An aft arm 27, which is an annular ridge defined on the first stage disk web 23 about the axis 2, extends from the web 23 aft of the first stage disk 20 to the web.

The second stage disk 30 includes a bore 32, a web 33 that extends radially outward from the disk bore 32, and a rim 34. The second stage disk rim 34 is configured to support a plurality of radially disposed second stage blades 36.

A mid-seal disk 40 is positioned between the first stage disk 20 and the second stage disk 30. The mid-seal disk 40 is a body of revolution and includes a bore 42, and a web 44. The aft arm 27 of the first stage disk web 23 connects to the web 44 of the mid-seal disk.

A plurality of second stage nozzle vanes 72 are radially distributed outwardly of the central plenum 60 such that the second stage nozzle vanes 72 are aft of the first stage blades 26 and forward of the second stage blades 36. The plurality of second stage nozzle vanes 72 is supported by an inner band 73. A forward hanger 75 is defined on the inner band 73 and extends radially inward. An aft hanger 77 is defined on the inner band 73 and extends radially inward.

A forward stator plate 87 is a body of revolution that is attached to forward hanger 75 of the inner band 73. The forward stator plate 87 extends radially inward from the forward hanger 75 to a forward honeycomb block 94 attached thereto. An aft stator plate 88 is a body of revolution that is attached to the aft hanger 77 of the inner band 73. The aft stator plate 88 extends radially inward from the aft hanger 77 to an aft honeycomb block 95 attached thereto. The forward stator plate 87 extends further away from the inner band 73 and closer to the axis 2 than the aft stator plate 88. According to the illustrated embodiment, the forward stator plate 87 and the aft stator plate 88 are solid annular structures.

A forward mid-seal 29 includes the forward honeycomb block 94 as a sealing element and a rotor 28. The rotor 28 is positioned on the aft arm 27. The rotor 29, as shown, is configured as a two-tooth labyrinth seal.

An annular aft mid-seal 47 includes the aft honeycomb block 95 as a sealing element and a rotor 48. The rotor 48 of an annular aft mid-seal 47 is defined on the mid-seal disk 40. The rotor 48 is configured as a three-tooth labyrinth seal in FIG. 1. It should be appreciated that the seals 29 and 47 can be configured as other types of rotating seals.

The rotor 28 of the forward mid-seal 29 and the rotor 48 of the aft mid-seal 47 are configured to sealingly engage the forward honeycomb block 94 and the aft honeycomb block 95 respectively and are positioned closer to the axis than conventional misdeals are. Stated another way, the method-seal disk 40 is of lower diameter than if the forward mid-seal 29 and the aft mid-seal 47 are positioned outwardly closer to the nozzle and 72. As a result, the potential leakage area across the forward to seal 29 in the aft seal 47 are lower than the potential leakage area in conventional seals.

An annular central plenum 60 is defined radially inward of the inner band 73. The central plenum 60 is defined by an inner boundary element 62, a forward boundary element 64, an aft boundary element 66, and an outer boundary element 68. The forward boundary element 64 is configured to separate the central plenum 60 from an annular forward chamber 56. The aft boundary element 66 is configured to separate the central plenum 60 from an annular aft chamber 58. The inner boundary element 62 is configured to fluidly separate the central plenum 60 from the chamber 25. In this regard, the inner boundary element 62 is generally a solid annular wall. As illustrated in FIG. 1, the inner boundary element 62 is defined by a portion of the aft arm 27.

A transfer pipe 80 passes through at least one of the second stage nozzle vanes 72. The transfer pipe 80 extends from within the central plenum 60 at one end to a diffuser 84 at another end. The diffuser 84 is positioned within an annular outer band plenum 93 that is defined in part by the outer band wall 89. A plurality of feed holes 86 are defined within the walls of beach transfer pipe 80. The feed holes 86 are configured to conduct cooling gas into the associated vane 72 as will be discussed further below. According to the illustrated embodiment, a transfer pipe 80 is associated with all of the radially distributed second stage nozzle vanes 72.

In the illustrated embodiment as shown in FIG. 1, the forward boundary element 64 is defined by the forward stator plate 87. A forward heatshield 91 is positioned forward of the stator plate 87. The aft boundary element 66 is defined by the aft stator plate 88. A heatshield 92 is positioned aft of the stator plate 88. It should be appreciated that the forward stator plate 87, the forward heatshield 91, the aft stator plate 88, and the heatshield 92 are all bodies of revolution.

A forward secondary flow circuit S1 is configured to conduct gas flow from the plenum 60 to the forward chamber 56 via the forward mid-seal 29. The flow circuit S1 continues radially outward away from the axis 2 to maintain a positive purge flow rate preventing high-temperature gases from entering the forward chamber 56.

An aft secondary circuit S2 is configured to conduct gas flow from the central plenum 60 into the aft chamber 58 via the aft mid-seal 47. The flow circuit S2 continues radially outward away from the axis 2 to maintain a positive purge flow rate preventing high temperature gases from passing inwardly into the aft chamber 58.

The structure described above can be better understood through a description of the operation thereof based on a section of the interstage structure 10. Gases are generated such that gas flow is generally radially inward from the outer band plenum 93 to the central plenum 60.

Pressure within the central plenum 60 acts to press forward on the forward stator plate 87 and aft on the aft stator plate 88. Because the aft mid-seal 47 is located further radially outward than the forward mid-seal 29, the aft stator plate is of less area than the forward stator plate 87. As a result, the pressure within the central plenum 60 applies a net load forward against the larger forward plate 87. The net result is that the aft axial load on the stator plates is reduced. Such a reduction in axial load allows for the stator plates to be of sufficient size for the forward mid-seal 29 and the aft mid-seal 47 to be positioned at the radially inward location.

It should be appreciated that some of the gases within the central plenum 60 leak out via the secondary circuits S1 and S2. The secondary circuit S1 extends through the mid-seal 29 and into the forward chamber 56 such that the forward chamber 56 and the central plenum 60 are fluidly connected. The engine 9 is configured such that the secondary cooling gas flow rate entering chamber 56 through mid-seal 29 is sufficient to prevent hot gases from traveling radially inward from the primary flowpath into the forward chamber 56. The pressure within the central plenum 60 is greater than the pressure within the forward chamber 56.

Circuit S2 extends through the aft mid-seal 47 and into the aft chamber 58 such that the aft chamber 58 and the central plenum 60 are fluidly connected. The engine 9 is configured such that the secondary cooling gas flow rate entering chamber 58 through mid-seal 47 is sufficient to prevent hot primary flowpath gases from traveling radially inward into the aft chamber 58. The gas pressure within the central plenum 60 is greater than the pressure within the aft chamber 58.

The gas turbine engine having a split mid-seal can have less leakage across the mid-seal than conventional seals because the mid-seal disk can have a smaller diameter and thus the mid-seal sealing circumference is smaller, then in conventional turbine engines. In addition, there is a forward load imparted to the forward stator 87 because the pressure within the central plenum 60 is greater than the pressure in the forward chamber 56. Likewise there is an aft load applied to the aft stator 88 because the pressure within the central plenum 60 is greater than the pressure within the aft chamber 58. The net axial load on aft on the forward stator 87 is less than it would have been with a conventional single mid-seal. Thus the load on the inner band 73 and hangers 75 and 77 is reduced.

The foregoing has described a structure for providing a turbine engine having a split misdeal with a lower diameter and resulting lower surface area for less leakage.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A turbine interstage structure for a gas turbine engine, the turbine interstage structure comprising:

a first stage disk;

a second stage disk;

a central plenum defined by an inner band for supporting nozzle vanes, a forward stator plate connected to and extending radially inward from a forward hanger of the inner band, an aft stator plate that is spaced-apart from the forward stator plate and connected to and extending radially inward from an aft hanger of the inner band, and an inner boundary;

a forward mid-seal positioned between the inner boundary and the forward stator plate, the forward mid-seal including a forward sealing element connected to an end of the forward stator plate;

an aft mid-seal positioned between the inner boundary and the aft stator plate, the aft mid-seal including an aft sealing element connected to an end of the aft stator plate; and wherein the inner boundary is a solid annular component.

2. A turbine interstage structure according to claim 1, comprising:

an outer band plenum that is fluidly connected to the central plenum.

3. A turbine interstage structure according to claim 2, comprising:

a transfer tube configured to fluidly connect the outer band plenum with the central plenum.

4. A turbine interstage structure according to claim 3, wherein the transfer tube passes through a nozzle vane.

5. A turbine interstage structure according to claim 4, wherein the transfer tube is perforated.

6. A turbine interstage structure according to claim 1, wherein at least one of the forward stator plate and the aft stator plate are of solid annular construction.

7. A turbine interstage structure according to claim 6, wherein the forward stator plate extends radially inward further from the inner band than the aft stator plate.

8. A turbine interstage structure according to claim 6, wherein a circumference of the forward sealing element of the forward mid-seal is less than a circumference of the aft sealing element of the aft mid-seal.

9. A turbine interstage structure according to claim 6, wherein a forward chamber is positioned between the first stage disk and the central plenum and an aft chamber is positioned between the central plenum and the second stage disk and wherein the pressure within the central plenum is greater than the pressure within a forward chamber and the pressure within the aft chamber.

10. A turbine interstage structure according to claim 6, wherein the central plenum is fluidly connected to a compressor discharge pressure source via a tube.

11. An aircraft engine that includes a turbine interstage structure, the aircraft engine comprising:

a first stage disk;

a second stage disk;

a central plenum defined by an inner band for supporting nozzle vanes, a forward stator plate connected to an extending radially inward from a forward hanger of the inner band, an aft stator plate that is spaced-apart from the forward stator plate and connected to and extending radially inward from an aft hanger of the inner band, and an inner boundary, wherein the forward stator plate extends radially inward further from the inner band than the aft stator plate;

a forward mid-seal positioned between the inner boundary and the forward stator plate, the forward mid-seal including a forward sealing element connected to an end of the forward stator plate and a rotor to sealingly engage the forward sealing element; and an aft mid-seal positioned between the inner boundary and the aft stator plate, the aft mid-seal including an aft sealing element connected to an end of the aft stator plate and a rotor to sealing engage the aft sealing element.

12. An aircraft engine according to claim 11, comprising:

an outer band plenum that is fluidly connected to the central plenum.

13. An aircraft engine according to claim 12, comprising:

a transfer tube configured to fluidly connect the outer band plenum with the central plenum.

14. An aircraft engine according to claim 13, wherein the transfer tube passes through a nozzle vane.

15. An aircraft engine according to claim 14, wherein the transfer tube is perforated.

16. An aircraft engine according to claim 11, wherein at least one of the forward stator plate and the aft stator plate are of solid annular construction.

17. A turbine interstage structure according to claim 16, wherein the central plenum is fluidly connected to a compressor discharge pressure source via a tube.

18. An aircraft engine according to claim 16, wherein a circumference of the forward sealing element of the forward mid-seal is less than a circumference of the aft sealing element of the aft mid-sea.

19. An aircraft engine according to claim 16, wherein a forward chamber is positioned between the first stage disk and the central plenum and an aft chamber is positioned between the central plenum and the second stage disk and wherein the pressure within the central plenum is greater than the pressure within a forward chamber and the pressure within the aft chamber.

* * * * *